US007404237B2

(12) United States Patent
Leinders

(10) Patent No.: US 7,404,237 B2
(45) Date of Patent: Jul. 29, 2008

(54) APPARATUS AT A SPINNING PREPARATION MACHINE FOR CHANGING SLIVER CANS

(75) Inventor: Christoph Leinders, Korschenbroich (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 180 days.

(21) Appl. No.: 11/303,948

(22) Filed: Dec. 19, 2005

(65) Prior Publication Data

US 2006/0130282 A1 Jun. 22, 2006

(30) Foreign Application Priority Data

Dec. 22, 2004 (DE) ..... 10 2004 063 027

(51) Int. Cl.
*D01G 27/00* (2006.01)

(52) U.S. Cl. ..... 19/159 A

(58) Field of Classification Search ..... 19/159 A, 19/159 R

See application file for complete search history.

(56) References Cited

U.S. PATENT DOCUMENTS

| | | | | |
|---|---|---|---|---|
| 3,435,485 | A * | 4/1969 | Stiepel | 19/159 R |
| 4,497,087 | A * | 2/1985 | Oehy | 19/159 A |
| 5,664,398 | A * | 9/1997 | Leifeld | 53/118 |

FOREIGN PATENT DOCUMENTS

| | | | |
|---|---|---|---|
| DE | 1 280 105 | A | 4/1963 |
| DE | 1 510 234 | A | 11/1969 |
| DE | 1 685 580 | A | 9/1971 |
| DE | 36 18 857 | | 12/1987 |
| DE | 36 18 857 | A1 | 12/1987 |
| DE | 101 16 944 | | 10/2002 |
| DE | 101 16 944 | A1 | 10/2002 |
| FR | 2 204 562 | | 5/1974 |
| GB | 1163702 | | 2/1968 |
| GB | 1436857 | | 11/1973 |

OTHER PUBLICATIONS

United Kingdom Search Report dated Apr. 20, 2006.
Preliminary Search Report from corresponding French Application No. FR 05 13017.

* cited by examiner

*Primary Examiner*—Shaun R Hurley
(74) *Attorney, Agent, or Firm*—Venable LLP; Robert Kinberg; Steven J. Schwarz

(57) ABSTRACT

In an apparatus at a spinning preparation machine for changing sliver cans, sliver is delivered by a delivery device and deposited in a sliver can. The apparatus comprises means for moving a full sliver can away from the region of the delivery device and means for subsequently bringing in an empty sliver can, from a reserve position to the region of the delivery device. An intermediate storage device is arranged to be brought in to the delivery device during changing of the sliver cans is provided. In order to avoid disadvantageous piling up of the sliver on the intermediate storage device and/or in the sliver can and to allow can changing at maximum sliver production speeds, the immediate storage device is arranged to be driven such that it is movable whilst collecting the sliver.

20 Claims, 4 Drawing Sheets

APPARATUS AT A SPINNING PREPARATION MACHINE FOR CHANGING SLIVER CANS

CROSS REFERENCE TO RELATED APPLICATION

This application claims priority from German Patent Application No. 10 2004 063 027.5 dated Dec. 22, 2004, the entire disclosure of which is incorporated herein by reference.

BACKGROUND OF THE INVENTION

The invention relates to an apparatus at a spinning preparation machine, for example a card, card drawing mechanism, draw frame, combing machine or the like, for changing sliver cans. In one known arrangement, sliver is delivered by a rotary plate and deposited in a sliver can, the arrangement comprising means for moving a full sliver can away from the region of the rotary plate, means for subsequently bringing in an empty sliver can from a position of readiness to the region of the rotary plate, and an intermediate storage means, for example a holding plate, arranged to be brought in to the rotary plate during changing of the sliver cans.

A known apparatus (DE 36 18 857 A) has an intermediate storage means in the form of a plate, which can be pivoted about an axis from a pivoted-out position to a position under the rotary plate. The plate is provided with a drive for the pivoting, preferably a pneumatic press. After separation of the sliver, which continues to be supplied, the intermediate storage means in the form of a plate is pivoted into a position under the rotary plate so that the separated sliver is caught by the plate. When the empty sliver can is placed under the rotary plate, the plate is moved out again. When the plate is moved out, which is preferably carried out with a jerking movement, the sliver deposited on the plate in the form of sliver cycloids is thrown off and transferred to the empty sliver can. In order to facilitate that throwing-off, the plate has a slight inclination such that the edge which is at the front while moving away from the region of the rotary plate is closer to the rotary plate. It is disadvantageous that the sliver continuing to run onto the plate becomes heaped into a column of sliver in undesirable manner, which results in its piling up in the empty can and consequently in a lack of uniformity. In addition, problems of space in the height direction also arise as a result. Finally, it is disadvantageous that can changing is not possible at maximum speed or in the region of the maximum speed without disadvantageous piling up of the sliver.

It is an aim of the invention to provide an apparatus of the kind described at the beginning that avoids or mitigates the mentioned disadvantages and that especially avoids disadvantageous piling up of the sliver on the intermediate storage means and/or in the sliver can and allows can changing at maximum sliver production speeds.

The invention provides a can-changing apparatus for a spinning preparation machine, comprising:

- a filling station at which a sliver can can be filled with fibre sliver from a sliver delivery device;
- a device for removing a full can from the filling station;
- a device for delivering an empty can to the filling station; and
- an intermediate storage device which can be positioned to collect sliver delivered during changing of the cans, in which the intermediate storage device is arranged to be driven such that it is movable beneath the delivery device whilst collecting the sliver.

As a result of the fact that the intermediate storage means is moved during deposition, disadvantageous piling up of the sliver is avoided both on the intermediate storage means and in the empty can. It is especially advantageous that can changing is possible at especially high sliver production speeds, ideally without—or without substantially—reducing the delivery speed of the sliver-producing machine. As a result of use of the intermediate storage means, operation at a higher delivery speed is possible during can changing. Because there exists a direct relationship between variations in delivery speed and the quality obtained during such variations, this increases both the efficiency of the machine and the quality of the sliver produced during can changing. In particular, disadvantageous drafting effects in the sliver are reduced or avoided.

In one preferred embodiment, the sliver can is an oblong can. Advantageously, the movement of the oblong can during deposition is a rectilinear, reciprocating movement. In that case, the movement of the intermediate storage means during changing of the oblong can is preferably a rectilinear, reciprocating movement. Advantageously, the intermediate storage means is arranged to be brought in in a direction perpendicular to the longitudinal axis of the oblong can.

In another preferred embodiment, the sliver can is a round can, and the movement of the round can during deposition is a rotary movement. In that case, the movement of the intermediate storage means during changing of the round can is preferably a rotary movement.

Advantageously, the intermediate storage means is arranged to be brought in in the direction towards the delivery device and away therefrom. Advantageously, the intermediate storage means is arranged to be brought into a position underneath the delivery device. Where the cans are oblong cans, the intermediate storage means, for example holding plate or the like, is advantageously substantially oblong. Where the cans are round cans, the intermediate storage means, for example holding plate or the like, is advantageously substantially round.

Advantageously, a clearing element or the like is provided, which can be used for clearing the sliver off from the intermediate storage means. Advantageously, the clearing element and the intermediate storage means are arranged to be moved relative to one another. Preferably, the clearing element is stationary. Advantageously, the clearing element is arranged between the sliver delivery device and the intermediate storage means. Advantageously, the clearing element is capable of clearing the sliver off from the upper surface of the intermediate element. In use, it is preferred that the cleared sliver drops into the empty can, for example, onto a lifting bottom of the empty can. Advantageously, a sliver separating device is provided. Advantageously, the sliver separating device is capable of separating the sliver deposited in the full can from the subsequently supplied sliver. For example, before deposition, there may be produced, in the sliver, a thin location from which the sliver tears off when the full can is moved away. Advantageously, the height of the intermediate storage means is adjustable relative to the sliver delivery device and/or the sliver can.

Where oblong cans are used, during change-over, the sliver delivery device is advantageously located at that end face of the full can which is next to the empty can. The full can may be moved away from and/or the empty can subsequently brought in perpendicular to the longitudinal direction of the can (via the long wall surface). Instead, the full can may be moved out and/or the empty can subsequently brought in in the longitudinal direction of the can (via the short wall surface).

It is preferred that, during changing of the sliver cans, sliver that continues to be supplied from the delivery device is deposited on the intermediate storage means.

The invention also provides an apparatus at a spinning preparation machine, for example a card, card drawing mechanism, draw frame, combing machine or the like, for changing sliver cans, wherein sliver is delivered by a rotary plate and deposited in a sliver can, comprising means for moving a full sliver can away from the region of a rotary plate, comprising means for subsequently bringing in an empty sliver can from a position of readiness to the region of the rotary plate and comprising an intermediate storage device, for example a holding plate, arranged to be brought in to the rotary plate during changing of the sliver cans, wherein there is associated with the intermediate storage device a drive element, which is capable of imparting to the intermediate storage device during changing of the sliver cans a movement which substantially corresponds to the movement of the sliver can during deposition of the sliver.

DETAILED DESCRIPTION OF PREFERRED EMBODIMENTS

Figure 1:
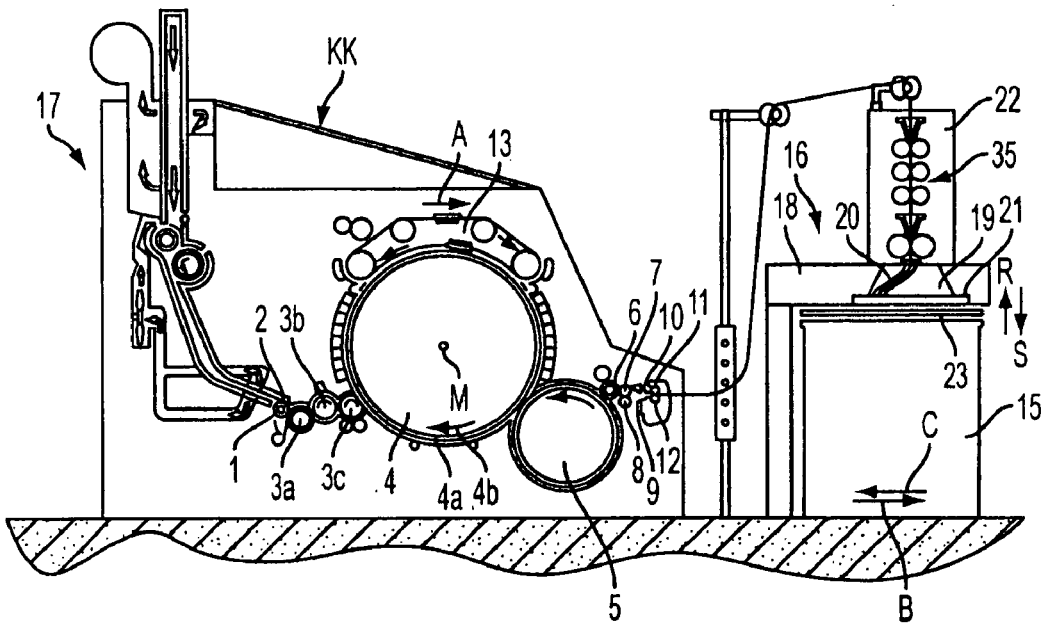
FIG. 1 is a diagrammatic side view of a card having a can coiler and rectangular can and also an apparatus according to the invention.

With reference to FIG. 1 a card KK, for example a TC 03 card made by Trutzschler GmbH & Co. KG of Monchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers and card top bars, rectangular can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. The arrow A denotes the work direction. Upstream of the card is a flock feeding apparatus 17. The coiler plate 19 is rotatably mounted in the coiler plate panel 18. The coiler plate 19 comprises a sliver channel 20, having a sliver inlet and outlet, and a rotary plate 21. Located above the can coiler covering panel 18 is a housing 22, in which the entry to rotating coiler plate 19 and a drawing mechanism 35 upstream thereof are located. The can 15 is in the form of a rectangular can and, during filling with sliver by the rotary plate 21, is moved to and fro in the direction of arrows B, C by means of a drive device (not shown). Arranged to be brought in between the underside of the rotary plate 21 and the top of the rectangular can 15 is an intermediate storage means in the form of a holding plate 23 that has an adjustable height (arrows R, S). The can 15 is in the form of a rectangular can and, during filling with sliver by the rotary plate 19, is moved to and fro in the direction of arrows B, C by means of a drive device (not shown). Arranged to be brought in between the underside of the rotary plate 21 and the top of the rectangular can 15 is an intermediate storage means in the form of a holding plate 23.

Figure 2:
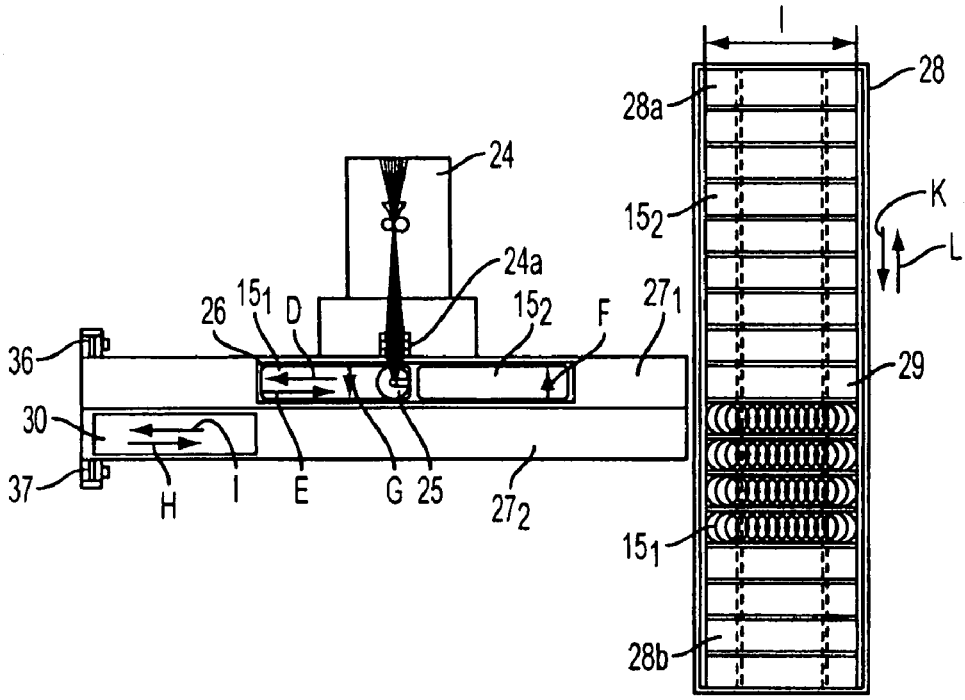
FIG. 2 is a diagrammatic top view of a draw frame for filling rectangular cans, having an apparatus according to a second embodiment of the invention, and also a can store.

FIG. 2 shows a draw frame 24 having a filling station, in which a can to be filled $\mathbf{15}_1$, which has an elongate cross-section, is located in a filling position. The sliver is fed to the can $\mathbf{15}_1$ via the coiler plate 25. For reasons of clarity, the sliver has been shown only in a short partial region. The coiler plate 25 is rotatably mounted in a stationary position in a frame (not shown in further detail). The sliver is fed to the coiler plate 25 in known manner by two calender rollers after it has been delivered to the calender rollers by drawing mechanism 24*a* of the draw frame 24. The diameter of the coiler plate 25 corresponds approximately to the width of the narrow side of the can $\mathbf{15}_1$. The can $\mathbf{15}_1$ is located on a carriage 26. In addition, an empty can $\mathbf{15}_2$ is located on the carriage 26. During the filling procedure, a reciprocating movement in the direction of arrows D, E is transmitted, by means of a displacement device, to the carriage 26 having the cans $\mathbf{15}_1$, $\mathbf{15}_2$. As a result, the can $\mathbf{15}_1$ in the filling position moves to and fro, over its entire length, underneath the coiler plate 25, whilst the empty can $\mathbf{15}_2$ in the reserve position on the carriage 26 moves along with it. The reciprocating movement extends over the filling path, which substantially corresponds to the length 1 of the can. The displacement device is driven by a speed-controlled electric motor. The carriage 26 is moved to and fro on a first path $\mathbf{27}_1$. (The direction of movement of the carriage 26 corresponds to the direction of movement E, D of the cans $\mathbf{15}_1$, $\mathbf{15}_2$.) Arranged parallel to the first path $\mathbf{27}_1$ is a second path $\mathbf{27}_2$, on which there is a carriage 30 for a rectangular can. The length of the paths $\mathbf{27}_1$, $\mathbf{27}_2$ corresponds to four times the length 1 of a can $\mathbf{15}_1$, $\mathbf{15}_2$. Parallel to the longitudinal side of the draw frame 24 there is provided a can store 28, which consists of an empty-can store 28*a* for empty cans $\mathbf{15}_2$ and a full-can store 28*b* for sliver-filled full cans $\mathbf{15}_1$. Seen in the direction of movement (arrows K, L) an intermediate space 29 is provided between the last empty can and the first full can. The empty and full cans $\mathbf{15}_1$, $\mathbf{15}_2$ are located on a conveyor belt, which endlessly revolves around return rollers and which is driven by an electric motor. Reference numerals 36 and 37 denote drive motors for the carriages 26 and 30, respectively.

Starting from the position and situation shown in FIG. 2, the sliver is delivered in operation by the stationary coiler plate 25 and is deposited in rings, and the can 151 carries out a movement to and fro (arrows D, E) during the filling procedure. Once the can $\mathbf{15}_1$ has been filled with sliver, the carriage 26 is, for the purpose of can changing, so moved through a can length 1 in the direction of arrow D that the empty can $\mathbf{15}_2$ is located underneath the coiler plate 25. The carriage 26 then undergoes reciprocating movement in direction D, E so that the can $\mathbf{15}_2$ is filled. At the same time, the carriage 30 moves to and fro in direction D, E parallel to the carriage 26 and to the can $\mathbf{15}_1$. In the process, the can $\mathbf{15}_1$ is moved in the direction of arrow G from the carriage 26 onto the carriage 30 by means of a displacement device (not shown). Then, whilst the can $\mathbf{15}_2$ is being filled, the carriage 30 moves in direction H into the gap 29 and transfers the full can $\mathbf{15}_1$ into the full-can magazine 28*b*. After that, an empty can $\mathbf{15}_2$ is moved from the empty-can magazine 28*a* onto the carriage 30, which is moved in direction I and which, on reaching the carriage 26, then moves parallel to and fro at the same speed as the empty position on the carriage 26 in the direction H, I. In the process, the empty can $\mathbf{15}_2$ is moved from the carriage 30 onto the carriage 26 in the direction of arrow F. On-the-fly can changing at maximum speed is accomplished in the manner shown. The continuing supply of sliver from the coiler plate 25 is neither interrupted nor slowed down during can changing. One advantage is that the cans $\mathbf{15}_1$, $\mathbf{15}_2$ are moved between the carriages 26 and 30 (arrows F, G) via the long walls of the rectangular cans, that is to say over short distances. A further particular advantage is the arrangement of two cans $\mathbf{15}_1$, $\mathbf{15}_2$ on one carriage 26, which makes possible especially fast can changing between the full can $\mathbf{15}_1$ and the empty can $\mathbf{15}_2$ by means of fast movement of the carriage 26 in the direction of arrow D. During can changing, the sliver is separated between the coiler plate 25 and full can $\mathbf{15}_1$, for example by means of a thin location—produced in the drawing mechanism 24*a*—at which the sliver tears off on movement of the carriage 26 together with the can $\mathbf{15}_1$ in direction D.

Figure 3A:
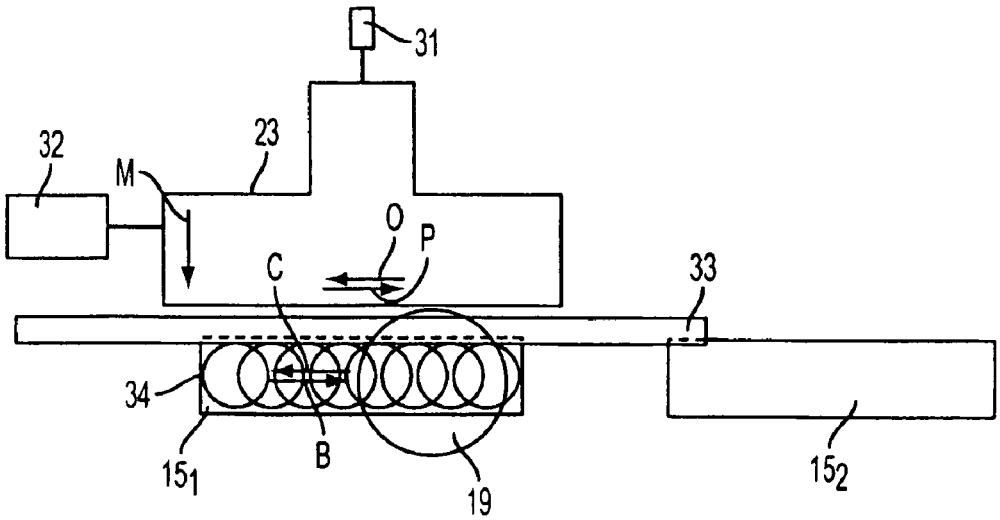
FIG. 3*a* shows a holding plate according to the invention spaced away from a rotary head with the empty can in the reserve position, beneath the rotary head.
Figure 3B:
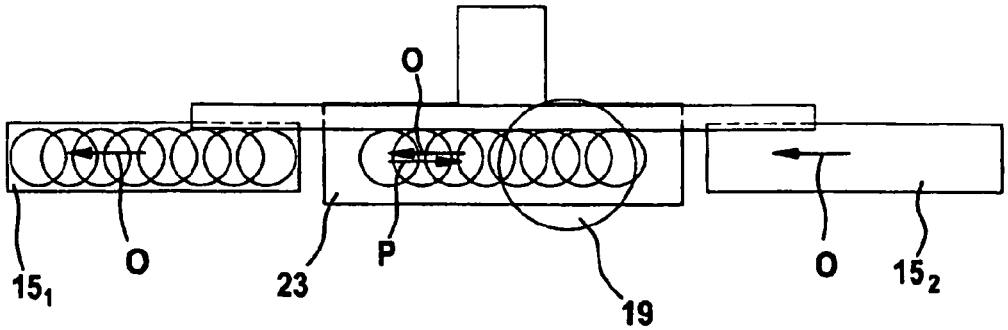
FIG. 3*b* shows the holding plate of FIG. 3*a* beneath the rotary head.
Figure 3C:
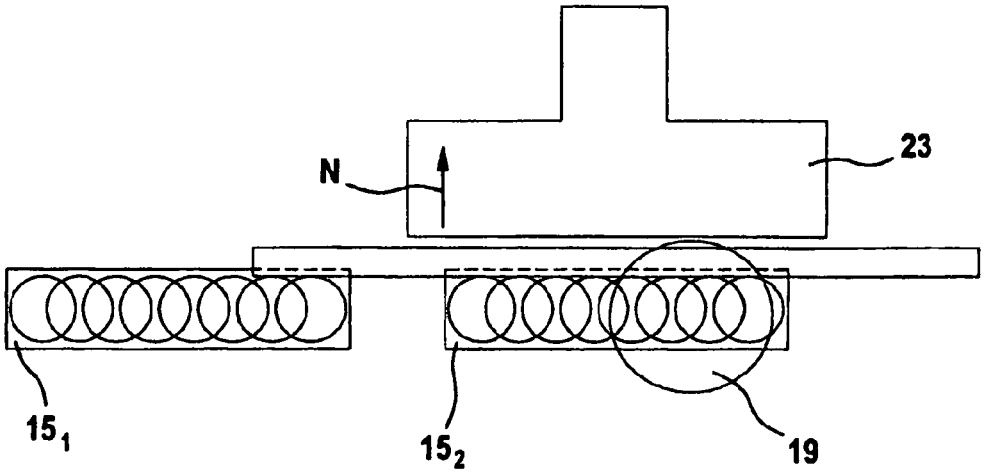
FIG. 3*c* shows the holding plate of FIG. 3*a* spaced away from the rotary head with the empty can in the filling position.

In the embodiment of FIG. 3*a*, sliver 34 is deposited in the form of rings by the coiler plate 19 in the full can $\mathbf{15}_1$ whilst it is being moved in direction B, C. The empty can $\mathbf{15}_2$ is located in a stationary reserve position. As an intermediate storage means there is provided a substantially rectangular holding plate 23, which is located away from the coiler plate 19 during filling of the can $\mathbf{15}_1$. Associated with the holding plate 23 is a drive element 31, for example a double-acting pneumatic cylinder or an electric motor having a direction of rotation that can be changed, by means of which the holding plate 23 can be moved in direction M, N. Also associated with the holding plate 23 is a further drive element 32, for example an electric motor having a speed of rotation direction that can be changed (a reversible electric motor), by means of which the holding plate 23 can be moved to and fro in the direction of arrows O, P. Reference numeral 33 denotes a clearing element. According to FIG. 3*b*, the can $\mathbf{15}_1$ has been moved completely out from the region of the coiler plate 19 in direction C. At the same time, the holding plate 23 has been moved in direction M to a position underneath the coiler plate 19 and is moved to and fro in that position in the direction of arrows O, P so that the sliver 34 delivered by the coiler plate 19 is deposited in the form of rings on the holding plate 23. Then, within a short time, the empty can $\mathbf{15}_2$ is moved into a position underneath the coiler plate 19. The holding plate 23 is then moved away from the region of the coiler plate 19 in direction N into the position shown in FIG. 3*c*. On movement of the holding plate 23 in direction N immediately beneath the clearing element 33, the sliver 34 is held back by the clearing element 33 and it drops down into the empty can 152. As a result of the movement of holding plate 23 in direction O, P, disadvantageous piling up of fibre material 34 is advantageously avoided during changing of the cans $\mathbf{15}_1$ and $\mathbf{15}_2$. In the process, the holding plate carries out substantially the same movement that the carriage 26 (see FIG. 2) carries out in direction D, B during filling of the can $\mathbf{15}_1$. On-the-fly can changing with high changing speeds for the cans $\mathbf{15}_1$, $\mathbf{15}_2$ is made possible, during which the delivery of fibre material 34 by the coiler plate 19 continues at a high speed during can changing.

In order to reduce the downtime during can changing or, in the case of the rectangular can $\mathbf{15}_1$, $\mathbf{15}_2$, to be able to carry out changing of the can without stopping the machine (K, 24) upstream, an intermediate storage means is used, which collects the material 34 during can changing. That intermediate storage means comprises a doubly driven storage plate 23. One drive 31 provides for moving the storage plate 23 into a position underneath the coiler plate 19 during can changing; another drive 32 moves the storage plate 23 beneath the coiler plate 19 so that the resulting deposition corresponds to that in the can $\mathbf{15}_1$. After changing of the cans, the empty can $\mathbf{15}_2$ is located underneath the storage plate 23. The latter is taken away (N, 31) from the depositing region, whilst a stationary clearing means 33 ensures that, in the process, the stored material 30 drops into the empty can $\mathbf{15}_2$. The spacing between the coiler plate 10 and the storage plate 23 is adjustable so that the capacity of the intermediate storage means can be modified. This adjustment is advantageous because the coiler plate should in principle be located as close as possible to the top of the can.

Figure 4:
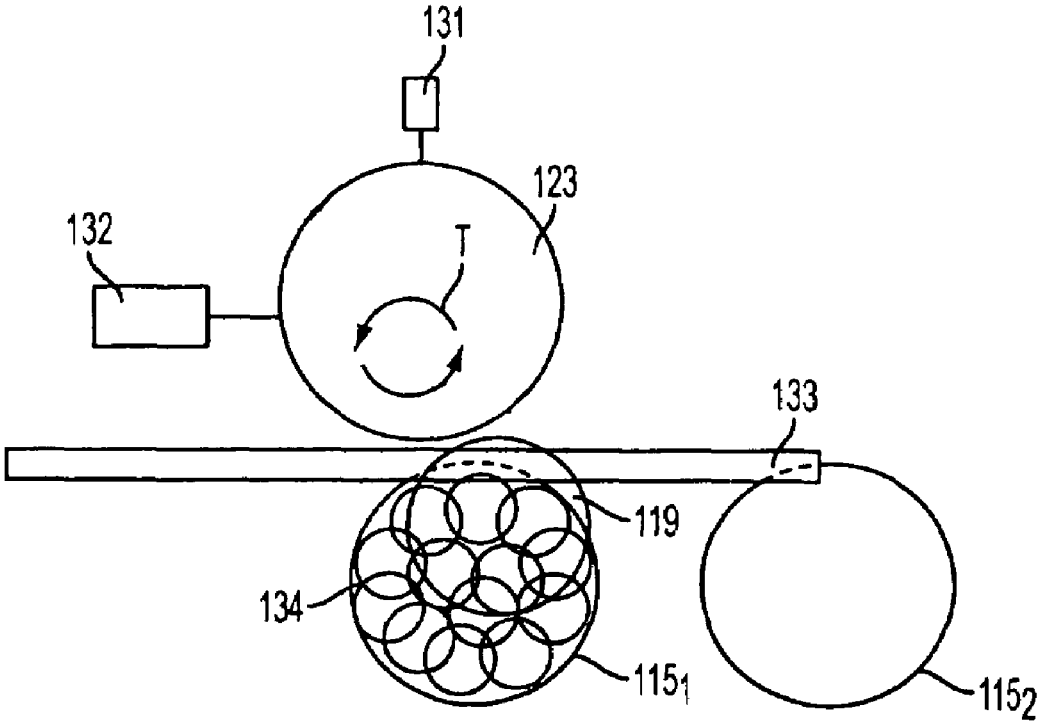
FIG. 4 shows a holding plate according to the invention spaced away from a rotary head with the empty can in the reserve position, beneath the rotary head.

FIG. 4 shows an embodiment similar to that of FIG. 3*a*, but with round cans ($\mathbf{115}_1$ and $\mathbf{115}_2$) and a substantially round holding plate 123 instead of the oblong cans ($\mathbf{15}_1$ and $\mathbf{15}_2$ of FIG. 3*a*) and rectangular holding plate 23 of FIG. 3*a*. In addition, the movement of the round can $\mathbf{115}_1$ during sliver deposition is a rotary movement, as shown; and the movement of the intermediate storage device 123 during the can changes is a rotary movement, as indicated by arrow T. The rest of the items depicted in FIG. 4 function in the same or similar manner as those shown in FIG. 3*a*, but are depicted by adding the prefix "1" to all the reference numerals shown in FIG. 3*a*.

Although the foregoing invention has been described in detail by way of illustration and example for purposes of understanding, it will be obvious that changes and modifications may be practised within the scope of the appended claims.

What is claimed is:

1. A can-changing apparatus for a spinning preparation machine, comprising:

a filling station at which a sliver can can be filled with fibre sliver from a sliver delivery device, the filling station adapted to impart movement to the sliver can during deposition of the sliver; a device for removing a full can from the filling station; a device for delivering an empty can to the filling station; and an intermediate storage device which can be positioned to collect sliver delivered during changing of the cans, in which the intermediate storage device is arranged to be driven such that it is movable beneath the delivery device in correspondence with the movement of the sliver can during deposition of the sliver.

2. An apparatus according to claim 1, in which the sliver can is an oblong can.

3. An apparatus according to claim 2, in which the movement of the oblong can during deposition is a rectilinear; reciprocating movement.

4. An apparatus according to claim 3, in which the movement of the intermediate storage device during changing of the oblong can is a rectilinear, reciprocating movement.

5. An apparatus according to claim 2, in which the intermediate storage device is arranged to be brought in in a direction perpendicular to a longitudinal axis of the oblong can.

6. An apparatus according to claim 2, in which the intermediate storage device comprises a substantially oblong plate for receiving deposited sliver during changing of the cans.

7. An apparatus according to claim 2, in which the arrangement is such that, during change-over, the full can is so positioned that the sliver delivery device is located at that end face of the full can which is next to the empty can.

8. An apparatus according to claim 7, in which the full can is moved out from the filling position and/or the empty can is subsequently brought in to the filling position in the longitudinal direction of the can (via the short wall surface).

9. An apparatus according to claim 2, in which the full can is moved away from the filling position and/or the empty can is subsequently brought in to the filling position perpendicular to the longitudinal direction of the can (via the long wall surface).

10. An apparatus according to claim 1, in which the sliver can is a round can, and the movement of the round can during deposition is a rotary movement.

11. An apparatus according to claim 1, in which the sliver can is a round can, and the movement of the intermediate storage device during changing of the round can is a rotary movement.

12. An apparatus according to claim 10, in which the intermediate storage device comprises a substantially round plate for receiving deposited sliver during changing of the cans.

13. An apparatus according to claim 1, in which the intermediate storage device is arranged to be brought in in the direction towards the delivery device and removed in a direction away therefrom.

14. An apparatus according to claim 1, in which the intermediate storage device is arranged to be brought in to a position underneath the sliver delivery device.

15. An apparatus according to claim 1, further comprising a clearing element, which can be used for clearing the sliver off from the intermediate storage device.

16. An apparatus according to claim 15, in which the clearing element is stationary.

17. An apparatus according to claim 15, in which the clearing element is arranged between the sliver delivery device and the intermediate storage device.

18. An apparatus according to claim 1, in which a sliver separating device is provided, the sliver separating device being capable of separating the sliver deposited in the full can from the subsequently supplied sliver.

19. An apparatus according to claim 1, in which the height of the intermediate storage device is adjustable relative to the sliver delivery device and/or the sliver can.

20. An apparatus at a spinning preparation machine for changing sliver cans, having a sliver delivery device for depositing fibre sliver in a moving fibre sliver can located in a filling position with respect to the delivery device, and an intermediate storage device, arranged to be positioned under the sliver delivery device for receiving sliver delivered during changing of the sliver can, wherein there is associated with the intermediate storage device a drive element, which is capable of imparting to the intermediate storage device, during changing of the sliver cans, a movement which substantially corresponds to the movement of the sliver can during deposition of the sliver therein.

* * * * *